US007736194B1

(12) United States Patent
Chang

(10) Patent No.: US 7,736,194 B1
(45) Date of Patent: Jun. 15, 2010

(54) UNIVERSAL ELECTRICAL PLUG

(75) Inventor: Pao-Hsing Chang, Hsinchu (TW)

(73) Assignee: Getac Technology Corporation, Hsinchu (TW)

( * ) Notice: Subject to any disclaimer, the term of this patent is extended or adjusted under 35 U.S.C. 154(b) by 0 days.

(21) Appl. No.: 12/499,786

(22) Filed: Jul. 8, 2009

(51) Int. Cl.
*H01R 24/00* (2006.01)

(52) U.S. Cl. ..... 439/675; 439/578

(58) Field of Classification Search ..... 439/675, 439/578, 825, 63, 581
See application file for complete search history.

(56) References Cited

U.S. PATENT DOCUMENTS

| | | | | | |
|---|---|---|---|---|---|
| 989,191 | A * | 4/1911 | Relth | 379/442 |
| 1,013,990 | A * | 1/1912 | Du Val | 439/825 |
| 1,104,720 | A * | 7/1914 | Turner | 439/825 |
| 1,828,276 | A * | 10/1931 | Beers | 439/553 |
| 2,051,549 | A * | 8/1936 | De La Hunt | 439/646 |
| 2,719,240 | A * | 9/1955 | Walker | 313/37 |
| 4,519,666 | A * | 5/1985 | Williams et al. | 439/578 |
| 4,525,013 | A * | 6/1985 | Phillips | 439/6 |
| 4,593,464 | A * | 6/1986 | Williams et al. | 29/879 |
| 4,753,616 | A * | 6/1988 | Molitor | 439/787 |
| 5,062,808 | A * | 11/1991 | Hosler, Sr. | 439/580 |
| 5,486,123 | A * | 1/1996 | Miyazaki | 439/825 |
| 5,562,506 | A * | 10/1996 | Wright | 439/675 |
| 6,024,609 | A * | 2/2000 | Kooiman et al. | 439/675 |
| 6,203,368 | B1 * | 3/2001 | Weidner | 439/579 |
| 6,299,489 | B1 * | 10/2001 | Phillips et al. | 439/675 |
| 6,447,323 | B1 * | 9/2002 | Watanabe | 439/371 |
| 6,568,964 | B2 * | 5/2003 | D'Addario | 439/675 |
| 6,729,912 | B2 * | 5/2004 | D'Addario | 439/675 |
| 6,869,316 | B2 * | 3/2005 | Hinkle et al. | 439/675 |
| 7,021,977 | B2 * | 4/2006 | Andersen | 439/857 |
| 7,294,022 | B1 * | 11/2007 | Cheng | 439/668 |
| 7,338,329 | B2 * | 3/2008 | Yang | 439/675 |
| 7,425,153 | B1 * | 9/2008 | Miller | 439/578 |
| 2004/0002266 | A1 * | 1/2004 | Hinkle et al. | 439/675 |
| 2004/0003498 | A1 * | 1/2004 | Swearingen et al. | 29/862 |
| 2008/0268717 | A1 * | 10/2008 | Mao | 439/675 |
| 2009/0053941 | A1 * | 2/2009 | Stuklek | 439/825 |

* cited by examiner

*Primary Examiner*—T C Patel
*Assistant Examiner*—Vladimir Imas
(74) *Attorney, Agent, or Firm*—Quintero Law Office, PC

(57) ABSTRACT

A universal electrical plug includes a first support, a second support, outer electrode slats, and inner electrode slats. An axis is defined from the second support to the first support. The outer and inner electrode slats are arranged on the second support, surround the axis, and extend to the first support in a direction parallel to the axis. The outer electrode slats are arranged on the second support and surround the inner electrode slats. Each outer electrode salt includes an outer deforming section bulged from the axis to fit insert holes of the electrical sockets with different sizes. Each inner electrode slate includes an inner deforming section depressed toward the axis to fit the electrode cores of the electrical sockets with different sizes. Through the outer and the inner electrode slats, the universal electrical plug is able to be adapted to the electrical sockets with different geometry specifications.

23 Claims, 10 Drawing Sheets

UNIVERSAL ELECTRICAL PLUG

BACKGROUND OF THE INVENTION

1. Field of the Invention

The present invention relates to electrical plugs, and more particularly to a universal electrical plug adapted to the electrical sockets with different sizes.

2. Related Art

Referring to FIG. 1, an electrical plug 1 in the prior art is disposed at an end of a power output cable of an electric transformer or a power supplier. The electrical plug is utilized to be inserted a corresponding electrical socket to electrically connect the electric transformer or the power supplier to the electrical socket, therefore supplying power to the electronic device equipped with the electrical socket.

Referring to FIG. 2, the electrical plug 1 includes a base portion 2, an outer sleeve 3, an inner sleeve 4. The base portion 2 is made of electrical insulating medium, and an end of the outer sleeve 3 is connected to the base portion 2. The inner sleeve 4 is disposed inside the outer sleeve 3, and the outer sleeve 3 and the inner sleeve 4 are spaced by an insulating ring 5 to prevent the outer sleeve 3 and the inner sleeve 4 from contacting each other. The electrical plug 1 further includes two leads 6, 7, buried in the base portion 2. The lead 6 is electrically coupled to the outer sleeve 3 while the lead 7 is electrically coupled to the inner sleeve 4, so as to connect the outer sleeve 3 and the inner sleeve 4 to the power output cable of the electric transformer or the power supplier.

Referring to FIG. 2, the electrical socket 8 corresponding to the electrical plug 1 includes a body 9, a conductive pin 10, and a plurality of contact reeds 11. The body 9 includes an inserted hole 12, and the conductive pin 10 is disposed at the bottom end of the inserted hole 12 of the inserted hole 12 and extends outwards in a central axis of the inserted hole 12. The contact reeds 11 are embedded on an inner wall of the inserted hole 12, and part of or the whole contact reed 11 protrudes beyond the inner wall of the inserted hole 11.

The following conditions are required for the sizes of the electrical plug 1 and the electrical socket 8 to inserting the electrical plug 1 into the electrical socket 8 and electrically connect the electrical plug 1 into the electrical socket 8. Firstly, the outer diameter of the outer sleeve 3 has to be smaller than or equal to the internal diameter of the inserted hole 12, so as to insert the outer sleeve 3 into the inserted hole 12. Furthermore, the external diameter of the outer sleeve 3 has to be large enough for the contact reed 11 to contact and clamp the outer sleeve 3. Secondly, the internal diameter of the inner sleeve 4 has to be slightly large the external diameter of the conductive pin 10, so as to insert the conductive pin 10 into the inner sleeve 4 to have the conductive pin 10 contacting and electrically connecting to the inner sleeve 4.

Referring to FIG. 2, the geometry specification of the electrical plug 1 has to match that of the electrical socket 8. If the internal diameter of the inserted hole 12' of an electrical socket 8' is to smaller than the external diameter of the outer sleeve 3, the outer sleeve 3 of the electrical plug 1 can not be inserted into the inserted hole 12'. On the contrary, if the inserted hole 12' of the electrical socket 8' is too large, the outer sleeve 3 can be inserted into the inserted hole 12'. However, under such condition, the outer sleeve 3 may not continuously contact with the contact reeds 11', or the outer sleeve 3 may not be fixed in the inserted hole 12' by the contact reeds 11'. Similarly, if the external diameter of the conductive pin 10' of the electrical socket 8' is larger than the internal diameter of the inner sleeve 4, the conductive pin 10' of the electrical plug 1 can not be inserted into the inner sleeve 4. On the contrary, if the external diameter of the conductive pin 10' is too small, the conductive pin 10' will not well contact with the inner sleeve 4 after the conductive pin 10 is inserted into the inner sleeve 4. According to the abovementioned reasons, every electric transformer or power supplier can only match one or a few types of electrical sockets 8 having matched geometry specifications. To electrical sockets 8, 8' having different geometry specifications, manufacturers of electronic devices have to reserve large amount of the electrical plugs 1 having different geometry specifications even the electrical specification of each electric transformer or power supplier can match the requirement of various types of electronic devices.

To solve the aforementioned problems, a solution in the prior art is to utilize detachable electrical plugs in electrical transformers or power suppliers. Such kind of electrical plug can be detached from the end power cable and replaced by another electrical plug having suitable geometry specification. However, the abovementioned solution has another problem that the user may lost the detachable electrical plugs detached from the power cable. Therefore, the electrical transformer or the power supplier may not be used any more if the frequently used detachable electrical plug is lost.

SUMMARY OF THE INVENTION

The present invention provides a universal electrical plug to solve the abovementioned problems in the prior art.

The universal electrical plug according to the present invention includes a first support, a second support, outer electrode slats, and inner electrode slats. An axis is defined from the second support to the first support. The outer and inner electrode slats are arranged on the second support, surround the axis, and extend to the first support in a direction parallel to the axis. The outer electrode slats are arranged on the second support and surround the inner electrode slats. Each outer electrode salt includes an outer deforming section bulged from the axis to fit insert holes of the electrical sockets with different sizes. Each inner electrode slate includes an inner deforming section depressed toward the axis to fit the electrode cores of the electrical sockets with different sizes. Through the outer and the inner electrode slats, the universal electrical plug is able to be adapted to the electrical sockets with different sizes.

BRIEF DESCRIPTION OF THE DRAWINGS

The present invention will become more fully understood from the detailed description given herein below for illustration only, and thus not limitative of the present invention, wherein.

DETAILED DESCRIPTION OF THE INVENTION

Figure 1:
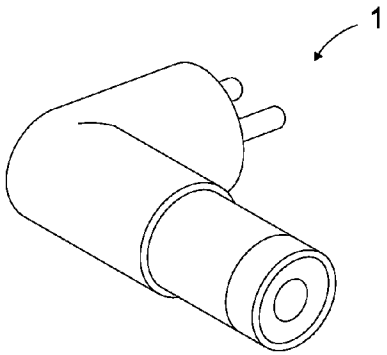
FIG. 1 (PRIOR ART)
FIG. 1 is a perspective view of an electrical plug in the prior art.
Figure 2:
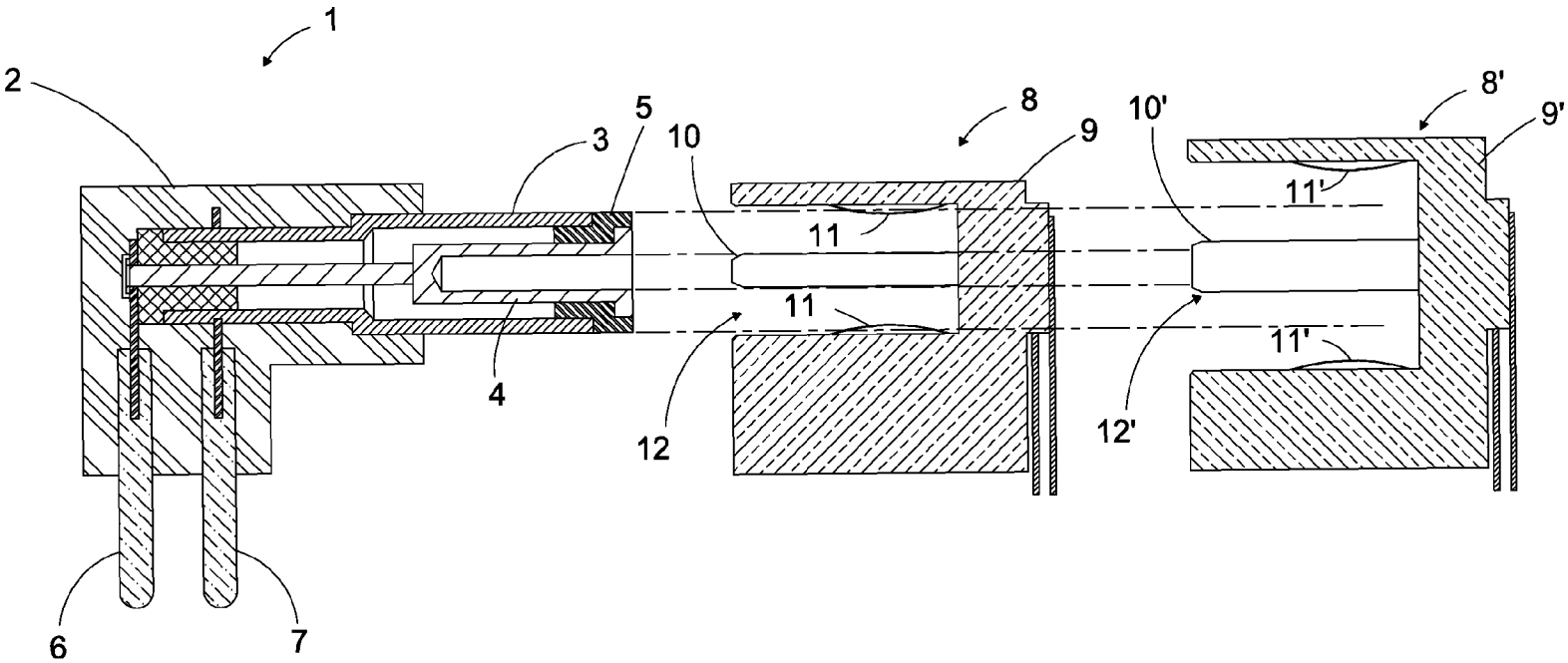
FIG. 2 (PRIOR ART)
FIG. 2 is cross-sectional view of the electrical plug inserted into an electrical socket in the prior art.
Figure 3:
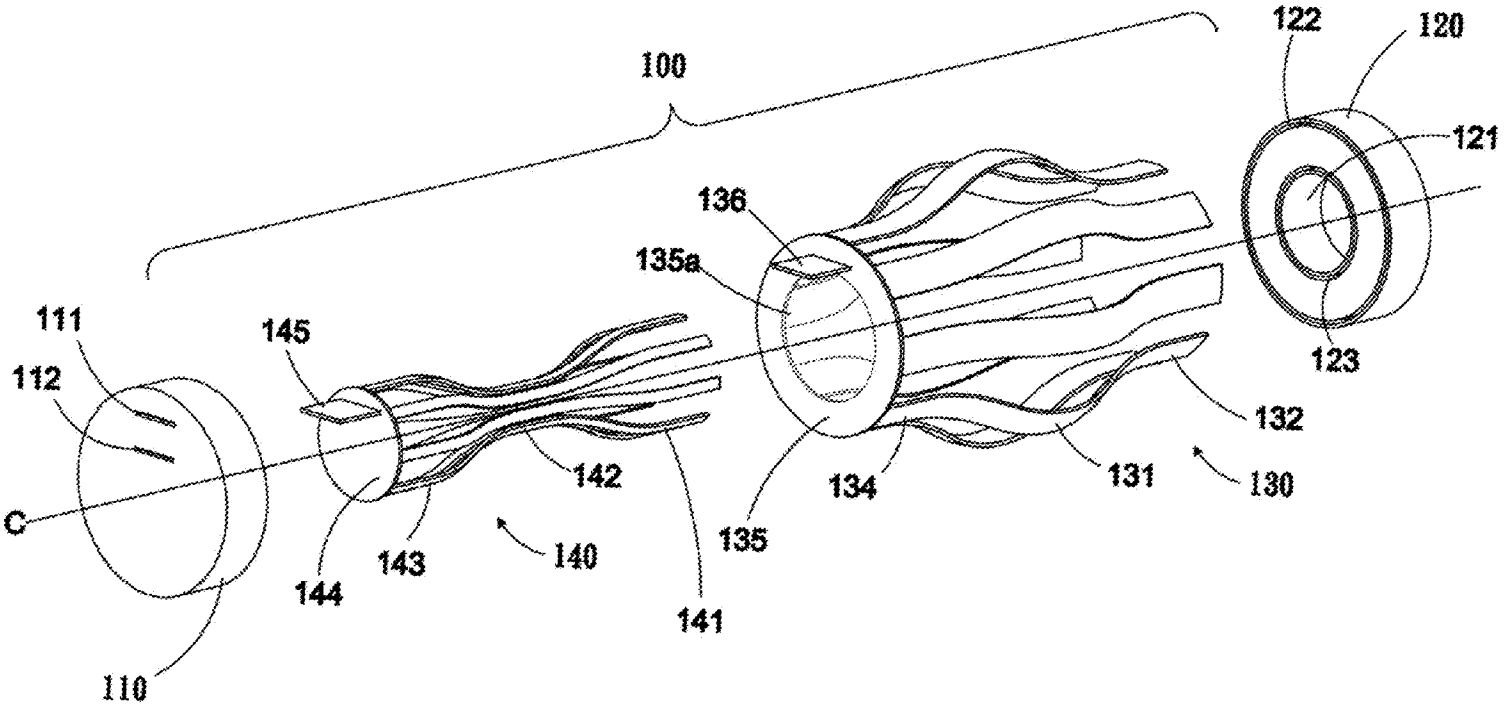
FIG. 3 is an exploded view of an according to a first embodiment of the present invention.
Figure 4:
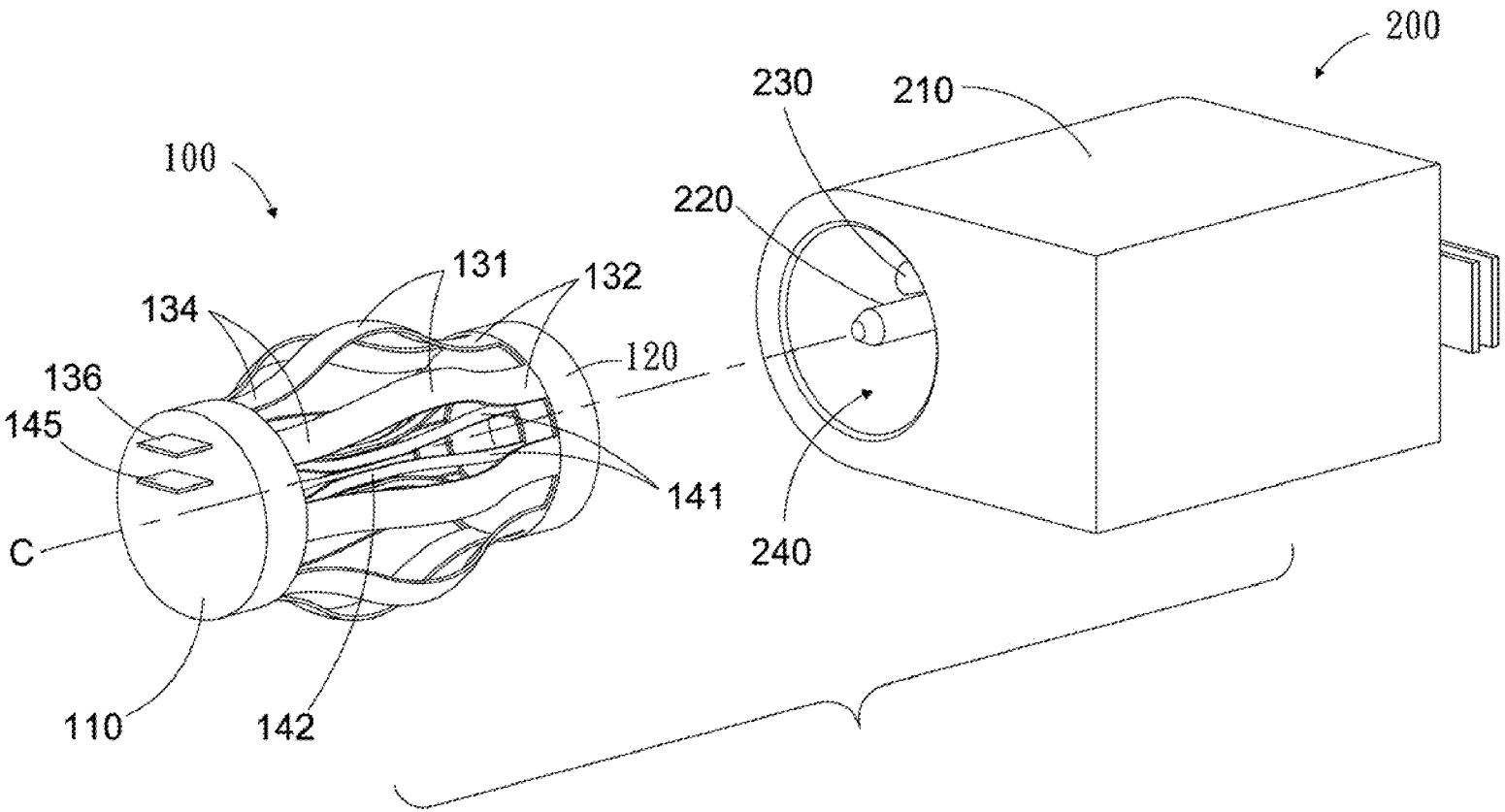
FIG. 4 is perspective view of the universal electrical plug and an electrical socket according to the first embodiment of the present invention.

Referring to FIG. 3 and FIG. 4, a universal electrical plug 100 according to a first embodiment of the present invention is show. The universal electrical plug 100 is able to be adapted to electrical sockets 200 with different geometry specifications. The universal electrical plug 100 includes a first support 110, a second support 120, a plurality of outer electrode slat 130, and plurality of inner electrode slat 140.

Referring to FIG. 3 and FIG. 4, the first support 110 is spaced from the second support 120. The configuration of the first support 110 can be annular, circle, or any other configuration. The configuration of the second support 120 can be any other configuration, and circle is preferred. The second support 120 includes a through hole 121. The first support 110 and the second support 120 are both made of electrical insulating medium, and are spaced from each other. An axis C is defined from the through hole 121 of the second support 120 to the first support 110.

Furthermore, the second support 120 includes an outer annular slot and an inner annular slot 123. The inner annular slot 123 surrounds through hole 121 and is located near an edge of the through hole 121. The outer annular slot 122 surrounds the inner annular slot 123 and is located near an edge of the second support 120.

Referring to FIG. 3 and FIG. 4, the inner electrode slats 140 are juxtaposed on second support 120 to surround the through hole 121, and each inner electrode slat 140 extend from the second support 120 to the first support 110 in a direction parallel to the axis. Two ends of each inner electrode slat 140 are connected to the first support 110 and the second support 120 respectively. Each of the inner electrode slats 140 includes an inner deforming section 142 in the middle. The end of each inner electrode slat 140 connected to the second support 120 is defined as a first end 141, and the end of each inner electrode slat 140 connected to the first support 110 is defined as a third end 143. The term "in the middle" is not restricted to the midpoint of each inner electrode slat 140, the term "in the middle" is any section between the first end 141 and the third end 143.

If the inner deforming section 142 is freely without being forced, the distance from the inner deforming section 142 to the axis C is normally smaller than the distance from the first end 141 to the axis C or the distance from the third end 143 to the axis C. That is, each inner deforming section 140 is a curved structure depressed toward the axis C. Moreover, each inner electrode slat 140 is made of electrical conductive and elastic material. Therefore each inner deforming section 142 can be forced to be deformed to change the distance from each inner deforming section 142 to the axis C.

The universal electrical plug 100 further includes a connection piece 144 and an inner welded bond 145. The inner welded bond 145 extends from the connection piece 144 and runs through the first support 110 through an inner slit 112, so as to fixing the connection piece 144 on a side surface of the first support 110 facing the second support 120.

The third end 143 of each inner electrode slat 140 extends from an edge of the connection piece 144 to connect the third end 143 to the first support 110. Moreover, the inner welded bond 145 is provided for a wire (not shown in the figures) to be welded thereon, and the wire is used to supply electrical power to each inner electrode slat 140. The first end 141 of each inner electrode slat 140 is inserted into inner annular slot 123 to connect the first end 141 to the second support 120.

Referring to FIG. 3 and FIG. 4, the outer electrode slats 130 are juxtaposed on second support 120 and surround through hole 121. Each of the outer electrode slats 130 extends to the first support 110 in a direction parallel to the axis C. Two end of each outer electrode slat 130 are connected to the first support 110 and the second support 120 respectively. A distance from each of the outer electrode slats 130 to the through hole 121 is slightly larger than the distance from each of the inner electrode slats 140 to through hole 121, therefore the outer electrode slats 130 surround the inner electrode slats 140.

Each of the outer electrode slats 130 includes an outer deforming section 131 in the middle. The end of each outer electrode slat 130 connected to the second support 120 is defined as a second end 132, and the end of each outer electrode slat 130 connected to the first support 110 is defined as a fourth end 134. The term "in the middle" is not restricted to the midpoint of each outer electrode slat 130, the term "in the middle" is any section between the second end 132 and the fourth end 134.

If the outer deforming section 131 is freely without being forced, the distance from the outer deforming section 131 to the axis C is normally larger than the distance from the second end 132 to the axis C or the distance from the fourth end 134 to the axis. That is, the outer deforming section 131 is a curved structure bulged out from the axis C. Moreover, each outer electrode slat 130 is made of electrical conductive and elastic material. Therefore, each inner deforming section 131 can be forced to be deformed to change the distance from each outer deforming section 131 to the axis C.

The universal electrical plug 100 further includes a connecting ring 135 and an outer welded bond 136. The connecting ring 135 has a cannular area 133*a*. The outer welded bond 136 extends from the connecting ring 135 and runs through the first support 110 through a outer slit 111, so as to fix the connecting ring 135 on a side surface of the first support 110 facing the second support 120.

The fourth end 134 of each outer electrode slat 130 extends from an edge of the connecting ring 135 to connect the fourth end 134 to the first support 110. Moreover, the connection piece 144 fixed to the first support 110 is located in the cannular area 135*a* without electrically connection to the connecting ring 135. Therefore, the outer electrode slats 130 are electrical insulated from the inner electrode slats 140. Moreover, the outer welded bond 136 is provided for a wire (not shown in the figures) to be welded thereon, and the wire is used to supply electrical power to each outer electrode slat 130. The second end 132 of each outer electrode slat 130 is inserted into the outer annular slot 122 to connect the second end 132 to the second support 120.

Figure 6:
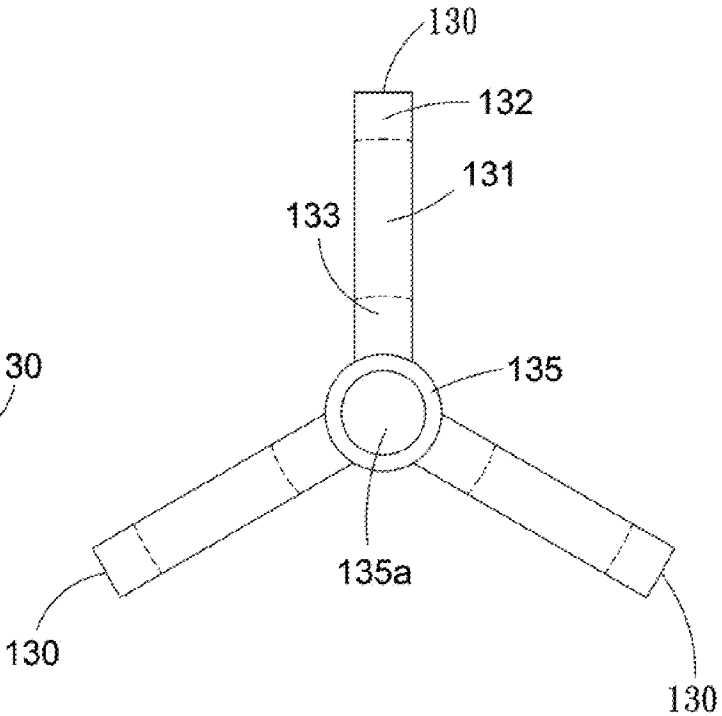
FIG. 5 and FIG. 6 are planar views of the outer electrode slat being unfold according to the first embodiment of the present invention.
Figure 5:
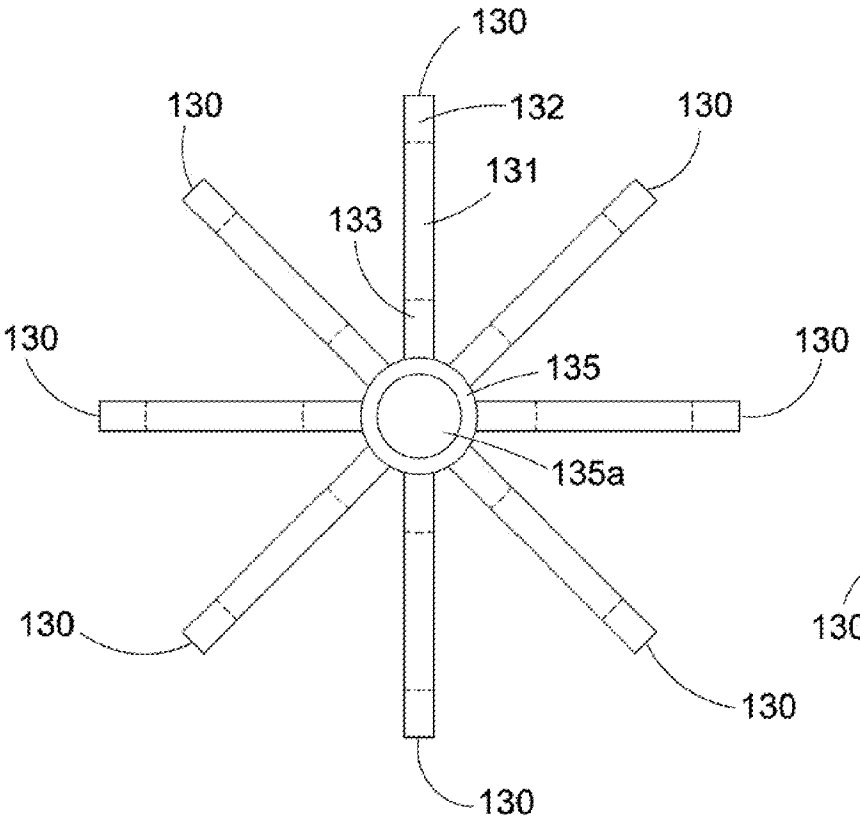

Referring to FIG. 5 and FIG. 6, the connecting ring 135 and the outer electrode slat 130 are formed monolithically. To manufacture the connecting ring 135 and the outer electrode slat 130, a metal thing plate is cut to have the outer electrode slats 130 extend from an edge of the connecting ring 135 in a radial manner. Then, each outer electrode slat 130 is folded to form the outer deforming section 131, the second end 132, and the fourth end 134.

Referring to FIG. 5 and FIG. 6, the amount of the outer electrode slats 130 is eight in the first embodiment. However, the amount "eight" is not a limitation of the present invention. The amount of the outer electrode slats 130 may be any amount. In practice, three or more than three outer electrode slats 130 are preferred, as shown in FIG. 6.

Figure 8:
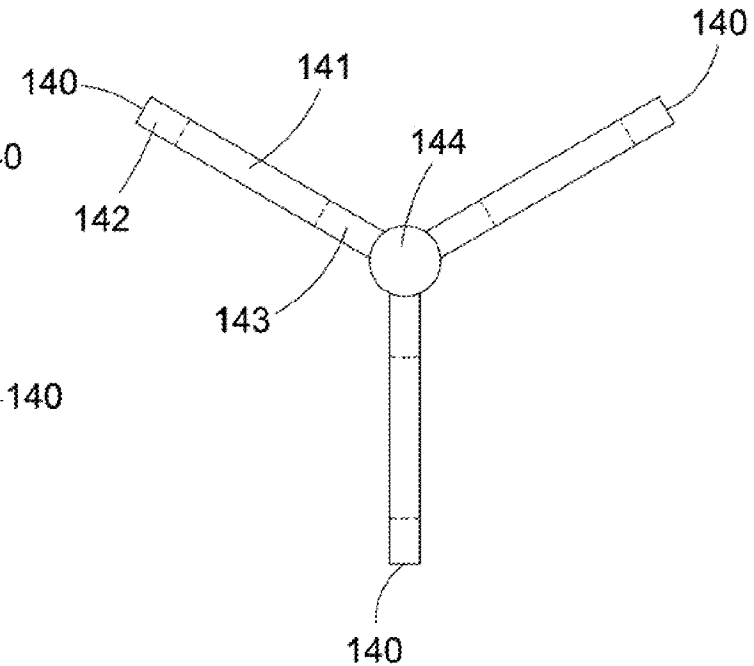
FIG. 7 and FIG. 8 are planar views of the inner electrode slat being unfold according to the first embodiment of the present invention.
Figure 7:
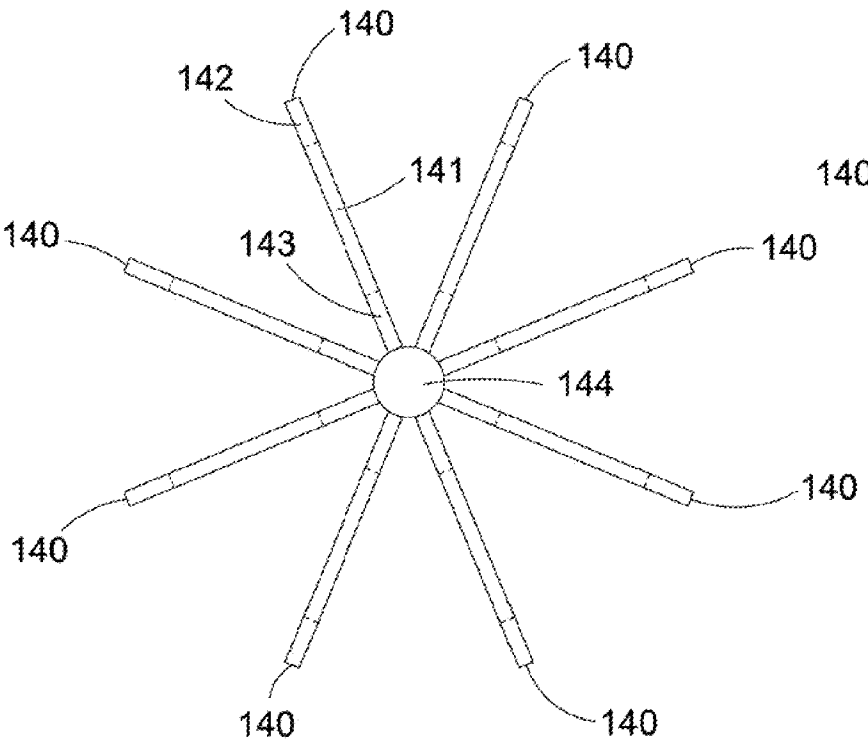

Referring to FIG. 7 and FIG. 8, the connection piece 144 and the inner electrode slats 140 are formed monolithically. To manufacture the connection piece 144 and the inner electrode slats 140, metal thing plate is cut to have the inner electrode slats 140 extend from an edge of the connection piece 144 in radial manner. Then, each inner electrode slat 140 is folded to form the inner deforming section 142, the first end 141, and the third end 143.

Referring to FIG. 7 and FIG. 8, the amount of the inner electrode slats 140 is eight in the first embodiment. However, the amount "eight" is not a limitation of the present invention. The amount of the inner electrode slats 140 may be any amount. In practice, three or more than three inner electrode slats 140 are preferred, as shown in FIG. 8.

Figure 9:
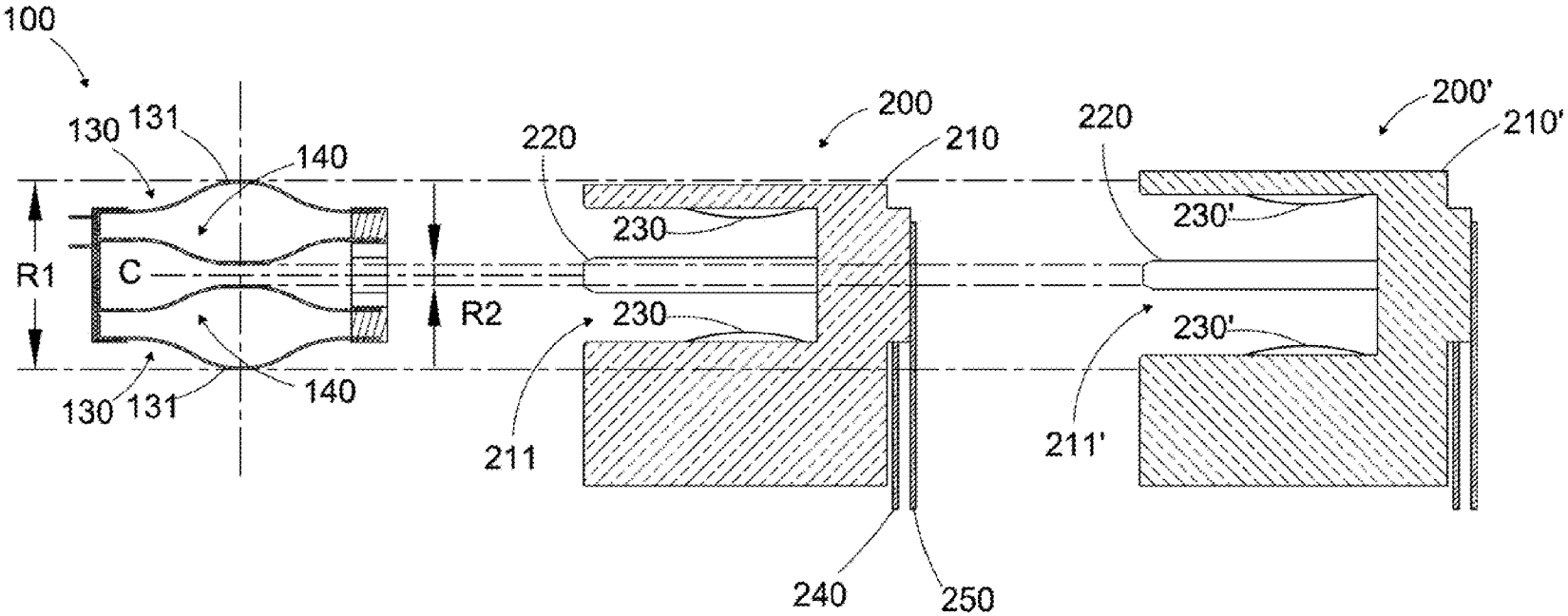
FIG. 9 is a cross-sectional view according to the first embodiment of the present invention, showing the universal electrical plug and the electrical socket to illustrate the geometry specifications of the electrical socket that adapts the universal electrical plug.

Referring to FIG. 3, FIG. 4, and FIG. 9, the outer electrode slats 130 are juxtaposed on the second support 120, surround the through hole 121, and extend in the direction parallel the axis C. A plurality of external diameters can be defined in the outer deforming sections 131 that surround the axis C. Among the aforementioned external diameters, a largest external diameter R1 exists. The inner electrode slats 140 are juxtaposed on the second support 120, surround the through hole 121, and extend in the direction parallel the axis C. Moreover, the inner electrode slats 140 are surrounded by the outer electrode slats 130. A plurality of internal diameters can be defined in the inner deforming sections 142 that surround the axis C. Among aforementioned the internal diameters, a smallest internal diameter R2 exist.

The electrical socket 200 includes a body 210, a conductive pin 220, and a plurality of contact reeds 230. The body 210 has an inserted hole 211. The conductive pin 220 is disposed at bottom of the inserted hole 211 and extends outwards. The contact reeds 230 are embedded on an inner wall of the inserted hole 211, and part of or the whole contact reed 230 protrudes beyond the inner wall of the inserted hole 211. The electrical conductivity paths of the conductive pin 220 and the contact reeds 230 extend outside the body 210 through leads 240, 250. And the leads 240, 250 are provided to be welded on a PCB, so as to mount the electrical socket 200 on the PCB.

FIG. 9 illustrates the geometry specifications of the electrical sockets 200, 200' that adapts the universal electrical plug 100 of the present invention. The largest external diameter R1 of the deforming sections 131 is larger than the bore diameter of the inserted hole 211, 211' of the body 210. Meanwhile, the smallest internal diameter R2 of the inner deforming sections 142 is smaller than the diameter of the conductive pin 220, 220'. As long as the geometry specifications of the electrical sockets 200, 200' match the abovementioned conditions, the universal electrical plug 100 of the present invention can be inserted into the inserted hole 211 to electrically connect the universal electrical plug 100 to the electrical sockets 200, 200'.

Figure 10:
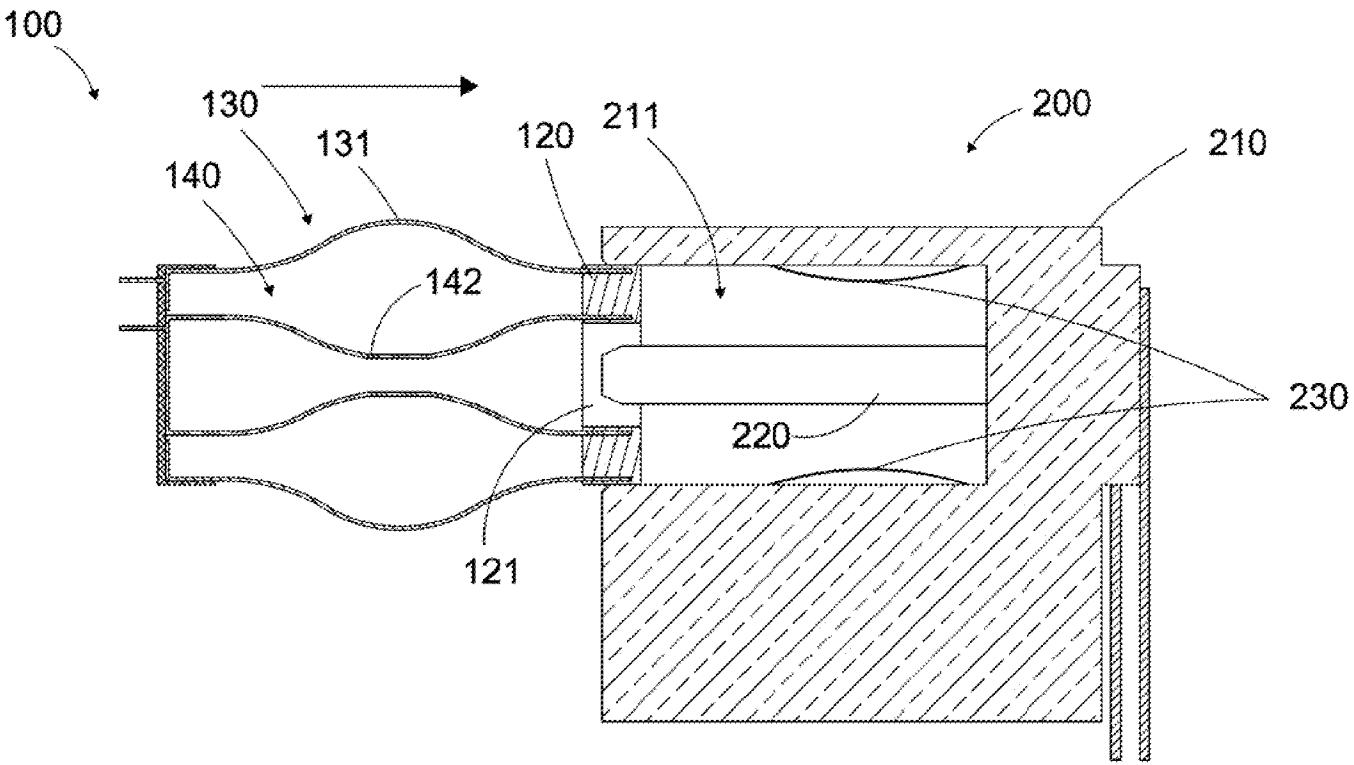
FIG. 10 and FIG. 11 are cross-sectional views according to the first embodiment of the present invention, showing the universal electrical plug and the electrical socket to illustrate inserting the electrical plug into the electrical socket.
Figure 11:
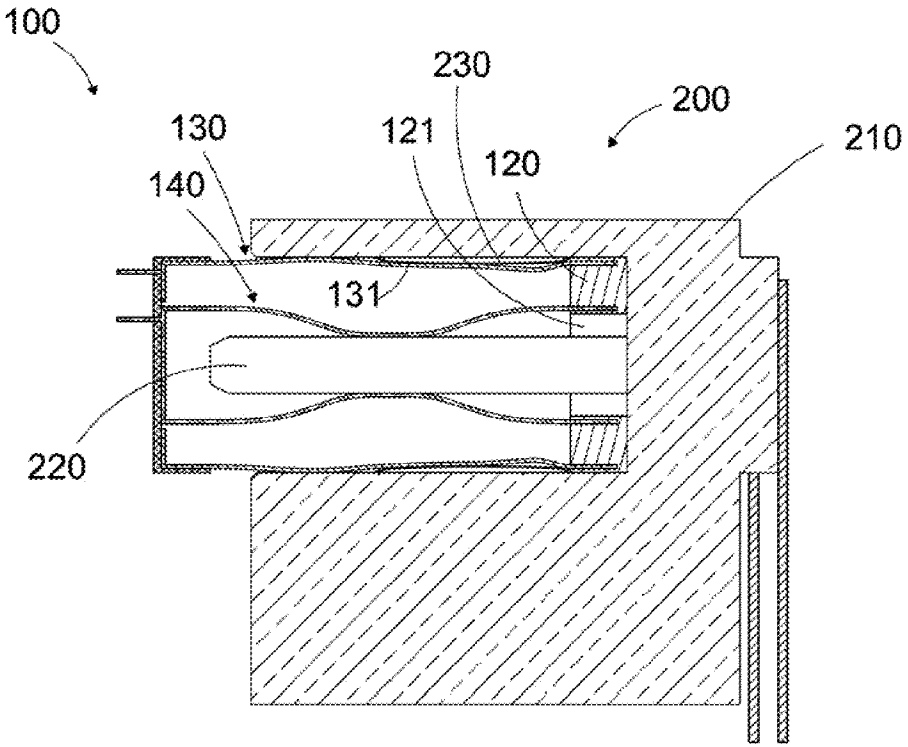

Referring to FIG. 10 and FIG. 11, when universal electrical plug 100 is inserted into the inserted hole 211 of the electrical socket 200, the second support 120 enters the inserted hole 211 at first, to have the conductive pin 220 runs through the second support 120 through the through hole 121, and then the second support 120 moves to the space surrounded by the inner electrode slats 140. Since the diameter of the conductive pin 220 is larger than the internal diameter R2 of the inner deforming sections 142, the conductive pin 220 contact the inner deforming sections 142 of the inner electrode slats 140. Moreover, the conductive pin 220 presses and forces the inner deforming sections 142 to be deformed outward. Meanwhile, the outer deforming sections 131 of the outer electrode slats 130 are pressed and forced to be deformed inwards by the inner wall of the inserted hole 211 or the contact reeds 230. The outer electrode slats 130 are forced to contact the inner wall of the inserted hole 211 or the contact reeds 230, therefore, at least one outer electrode slats 130 normally contact the contact reeds 230. As long as the bore diameter of the inserted hole 210 is smaller than the largest external diameter R1 and the diameter of the conductive pin 220 is larger the smallest internal diameter R2, the universal electrical plug 100 is fixed in the inserted hole 211, and the inner electrode slats 140 and outer electrode slats 130 are electrical connected to the conductive pin 220 and the contact reeds 230 respectively. The range of the bore diameter of the inserted hole 211 corresponding to outer electrode slats 130 is enlarged, while the range of the diameter of the conductive pin 220 corresponding to the inner electrode slats 140 is enlarged. Therefore, the universal electrical plug of the present invention is able to be adapted to the electrical sockets 200, 200' with different geometry specifications.

Figure 12:
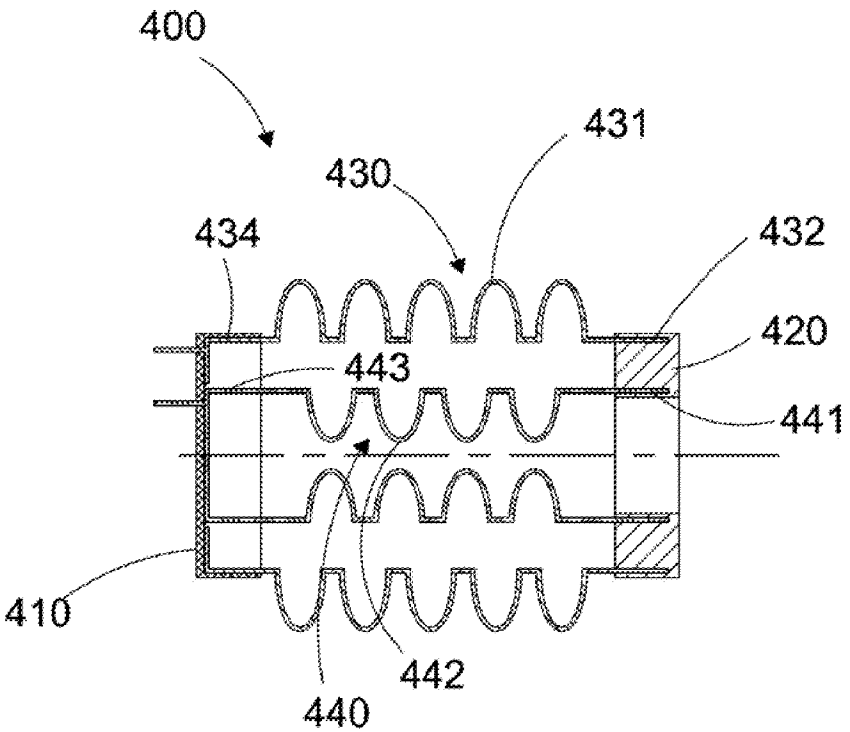
FIG. 12 is cross-sectional view of a universal electrical plug according to the first embodiment of the present invention.

Referring to FIG. 12, a universal electrical plug 400 according to a second embodiment of the present invention includes a first support 410, a second support 420, a plurality of outer electrode slats 430, and a plurality of inner electrode slats 440. The details of first support 410 and the second support 420 are similar to those of the first embodiment and will not be described again here after.

The inner electrode slats 440 are juxtaposed on the second support 420 and surround the through hole 421. Each inner electrode slat 440 extends from the second support 420 to the first support 410 in a direction parallel to the axis C. Each of the inner electrode slats 440 includes a plurality of serial connected inner deforming sections 442 in the middle of the inner electrode slat. The end of each inner electrode slat 440 connected to the second support 420 is defined as a first end 441, and the end of each inner deforming section 442 connected to the first support 410 is defined as a third end 443. the term "in the middle" is not restricted to the midpoint of each inner electrode slat 440, the term "in the middle" is any section between the first end 441 and the third end 443. The first end 441 and the second end is connected to the second support 420 and the first support 410 respectively, and the distance from each inner deforming section 442 to the axis C is smaller than the distance from the first end 441 to the axis C. Moreover, each inner deforming section 442 is deformable to change the distance from each inner deforming section 442 to axis C.

The outer electrode slats 430 are juxtaposed on second support 420 and surround the through hole 421. Each of the outer electrode slat 430 extends to the first support 410 in a direction parallel the axis C. The distance from each outer electrode slat 430 to the through hole 421 is slightly larger than the distance from the inner electrode slat 440 to the through hole 421, therefore, the outer electrode slats 430 surround the inner electrode slat 440.

Each outer electrode slat 430 includes a plurality of serial connected outer deforming section 431 in the middle of the outer electrode slat 430. The end of each outer electrode slat 430 connected to the second support 420 is defined as a second end 432, and the end of the outer electrode slat 430 connected to the first support 410 is defined as a fourth end 434. The term "in the middle" in not restricted to the midpoint of the out electrode slat 430, the term "in the middle" is any section between the second end 432 and the fourth end 434. If each outer deforming section 431 is not forced, the distance from the outer deforming section 431 to the axis C is normally larger than the distance from the second end 432 to the axis C or the distance from the fourth end 434 to the axis C. And each outer deforming section 431 is deformable to change the distance from the outer deforming section 431 to the axis C.

Through bulged out outer deforming sections and depressed inner deforming sections, the universal electrical plug according to one or more embodiments of the present invention matches various geometry specifications of the electrical sockets, that is, the universal electrical plug is able to be adapted to the electrical sockets with different geometry specifications.

What is claimed is:

1. An universal electrical plug, comprising:

a first support and a second support separated by a space so as not to be in physical contact with each other, a through hole being defined on the second support with an axis extending form the through hole to the first support;

a plurality of inner electrode slats juxtaposed on the second support to surround the through hole, and each of the inner electrode slats extending across the space separating the first support and the second support in a direction parallel to the axis; each of the inner electrode slats including at least one inner deforming section in the middle thereof and arranged in the space separating the first support and the second support, a first end connected to the second support, and a third end connected to the first support; a distance from each of the inner deforming sections to the axis being normally smaller than the distance from the first end to the axis, the inner deforming section being deformable to change the distance from the inner deforming section to the axis; and a plurality of outer electrode slats, juxtaposed on the second support to surround the through hole, and each of the outer electrode slats extending across the space separating the first support and the second support in a direction parallel to the axis; a distance from each of the outer electrode slats to the through hole being larger than the distance from each of the inner electrode slats to the through hole; each of the outer electrode slats including at least one outer deforming section in the middle thereof and arranged in the space separating the first support and the second support, a second end connected to the second support, and a fourth end connected to the first support; a distance from each of the outer deforming section to the axis being large than the distance from the second end the axis, the outer deforming section being deformable to change the distance from the outer deforming section to the axis.

2. The universal electrical plug as claimed in claim 1, wherein the second support includes:

an inner annular slot, surrounding the through hole, and the first end of each of the inner electrode slats be inserted to the inner annular slot; and an outer annular slot, surrounding the inner annular slot, and the second end of each of the outer electrode slat being inserted into the outer annular slot.

3. The universal electrical plug as claimed in claim 1, wherein a distance from each of the inner deforming sections to the axis is normally smaller than the distance from third end to the axis.

4. The universal electrical plug as claimed in claim 1, wherein a distance from each of the outer deforming section to the axis is normally larger than the distance from the fourth end to the axis.

5. The universal electrical plug as claimed in claim 1, further comprising a connecting ring having a cannular area, fixed on the first support, and extending toward a side surface of the second support, and each of the outer electrode slats extending from an edge of the connecting ring.

6. The universal electrical plug as claimed in claim 5, further comprising an outer welded bond, extending from the connecting ring and running through the first support.

7. The universal electrical plug as claimed in claim 5, wherein the connecting ring and the outer electrode slats are formed monolithically.

8. The universal electrical plug as claimed in claim 5, further comprising a connection piece, fixed to the first support, extending toward a side surface of the second support, located in the cannular area without electrically connection to the connecting ring, and the inner electrode slats extending from an edge of the connecting ring.

9. The universal electrical plug as claimed in claim 8, wherein the connection piece and the inner electrode slats are formed monolithically.

10. The universal electrical plug as claimed in claim 8, further comprising an inner welded bond, extending from the connection piece and running through the first support.

11. The universal electrical plug as claimed in claim 1, wherein each of the inner electrode slats includes a plurality of serial connected inner deforming sections in the middle of the inner electrode slat.

12. The universal electrical plug as claimed in claim 1, wherein each of the outer electrode slats includes a plurality of serial connected outer deforming section in the middle of the outer electrode slat.

13. An universal electrical plug, comprising:

a first support and a second support spaced from each other, a through hole being defined on the second support with an axis extending form the through hole to the first support;

a plurality of inner electrode slats juxtaposed on the second support to surround the through hole, and each of the inner electrode slats extending to the first support in a direction parallel to the axis; each of the inner electrode slats including at least one inner deforming section in the middle thereof and a first end connected to the second support; a distance from each of the inner deforming sections to the axis being normally smaller than the distance from the first end to the axis, the inner deforming section being deformable to change the distance from the inner deforming section to the axis; and a plurality of outer electrode slats, juxtaposed on the second support to surround the through hole, and each of the outer electrode slats extending to the first support in a direction parallel to the axis; a distance from each of the outer electrode slats to the through hole being larger than the distance from each of the inner electrode slats to the through hole; each of the outer electrode slats including at least one outer deforming section in the middle thereof and a second end connected to the second support; a distance from each of the outer deforming section to the axis being large than the distance from the second end the axis, the outer deforming section being deformable to change the distance from the outer deforming section to the axis;

wherein each of the inner electrode slats includes a plurality of serial connected inner deforming sections in the middle of the inner electrode slat.

14. The universal electrical plug as claimed in claim 13, wherein the second support includes:

an inner annular slot, surrounding the through hole, and the first end of each of the inner electrode slats be inserted to the inner annular slot; and an outer annular slot, surrounding the inner annular slot, and the second end of each of the outer electrode slat being inserted into the outer annular slot.

15. The universal electrical plug as claimed in claim 13, wherein each of the inner electrode slats includes a third end connected to the first support, and a distance from each of the inner deforming sections to the axis is normally smaller than the distance from third end to the axis.

16. The universal electrical plug as claimed in claim 13, wherein each of the outer slats includes a fourth end connected to the first support, and a distance from each of the outer deforming section to the axis is normally larger than the distance from the fourth end to the axis.

17. The universal electrical plug as claimed in claim 13, further comprising a connecting ring having a cannular area, fixed on the first support, and extending toward a side surface of the second support, and each of the outer electrode slats extending from an edge of the connecting ring.

18. The universal electrical plug as claimed in claim 17, further comprising an outer welded bond, extending from the connecting ring and running through the first support.

19. The universal electrical plug as claimed in claim 17, wherein the connecting ring and the outer electrode slats are formed monolithically.

20. The universal electrical plug as claimed in claim 17, further comprising a connection piece, fixed to the first support, extending toward a side surface of the second support, located in the cannular area without electrically connection to the connecting ring, and the inner electrode slats extending from an edge of the connecting ring.

21. The universal electrical plug as claimed in claim 20, wherein the connection piece and the inner electrode slats are formed monolithically.

22. The universal electrical plug as claimed in claim 20, further comprising an inner welded bond, extending from the connection piece and running through the first support.

23. The universal electrical plug as claimed in claim 13, wherein each of the outer electrode slats includes a plurality of serial connected outer deforming section in the middle of the outer electrode slat.

* * * * *